US008181477B2

(12) United States Patent
Ducharme et al.

(10) Patent No.: US 8,181,477 B2
(45) Date of Patent: May 22, 2012

(54) ICE MAKING DEVICE

(76) Inventors: David R. Ducharme, Anderson, SC (US); Russell E. Watts, Starr, SC (US); Hiroki Kuratani, Nagano (JP)

( * ) Notice: Subject to any disclaimer, the term of this patent is extended or adjusted under 35 U.S.C. 154(b) by 615 days.

(21) Appl. No.: 12/389,127

(22) Filed: Feb. 19, 2009

(65) Prior Publication Data

US 2010/0205995 A1 Aug. 19, 2010

(51) Int. Cl.
*F25C 5/18* (2006.01)

(52) U.S. Cl. ..... 62/344; 625/353

(58) Field of Classification Search ..... 62/341, 62/353, 344, 66

See application file for complete search history.

(56) References Cited

U.S. PATENT DOCUMENTS 5,187,948 A * 2/1993 Frohbieter ..... 62/351

FOREIGN PATENT DOCUMENTS

| | | |
|---|---|---|
| JP | 8-54164 A | 2/1996 |
| JP | 8054164 | 2/1996 |
| JP | 9264645 | 10/1997 |

OTHER PUBLICATIONS

International Search Report for PCT/US2010/024413, dated Oct. 28, 2010, 2 pages.

* cited by examiner

*Primary Examiner* — Mohammad Ali
(74) *Attorney, Agent, or Firm* — Pearne & Gordon LLP

(57) ABSTRACT

An ice making device may include an ice tray, a drive mechanism for moving the ice tray to a water-supply position and to an ice making position, two guide plates each of which is formed with a guide groove for guiding the ice tray to the water-supply position and to the ice making position, two engaging projections provided on the ice tray and each of which is engaged with the guide groove, and two cranks each of which is formed with a drive groove with which the engaging projection is engaged and is connected with the drive mechanism to be turned for moving the ice tray. The water-supply position is located at a position separated from the ice making position in a lateral direction, and the two engaging projections are provided on the ice tray so that their axial direction are substantially coincided with each other, and a gravity center position of the ice tray is located on a lower side of the two engaging projections.

12 Claims, 7 Drawing Sheets

ICE MAKING DEVICE

FIELD OF THE INVENTION

An embodiment of the present invention may relate to an ice making device which is assembled into and used in a refrigerator.

BACKGROUND OF THE INVENTION

An ice making device for automatically making ice pieces has been conventionally known which includes two arms, which are respectively fixed to each of both ends of an ice tray, an elevating/lowering member which supports the arms from a lower side to perform up-and-down motion, and a drive motor and a rotation body for moving the elevating/lowering member up and down (see, for example, Japanese Patent Laid-Open No. Hei 8-54164).

The ice making device disclosed in the above-mentioned Patent Reference is structured so that two arms fixed in parallel to the both ends of the ice tray are moved up-and-down along a pair of guide grooves. One of the guide grooves is structured of a combination of a straight line region and a curved region which is disposed on its lower side, and the other of the guide grooves is structured of only a straight line region. Therefore, in the ice making device, when the elevating/lowering member is moved lower than the straight line region of the guide groove, only one of the arms is moved downward along the curved region of the one of the guide grooves and thus the ice tray is turned 90° (90 degree) with the other arm as a turning center. Further, in the ice making device, a heater is mounted on the ice tray and, when the ice tray is turned 90° (90 degree), ice pieces whose contacting portions with the ice tray are warmed by the heater and melted are dropped from the ice tray.

In the ice making device which is disclosed in the above-mentioned Patent Reference, two parallel arms are moved up-and-down along a pair of the guide grooves. Therefore, when the two arms fixed to the ice tray are moved up-and-down, the ice tray is liable to tilt. Further, when the ice tray is tilted, a side face of the guide groove is contacted with the arm and thus an unfavorable force may be easily applied to the arm. Further, in the ice making device, when the elevating/lowering member is moved lower than the straight line region of the guide groove, only one of the arms is moved downward along the curved region of the one of the guide grooves and thus the ice tray is turned 90° with the other arm as a fulcrum. Therefore, in a case that dimensional accuracy of a pair of the guide grooves is low, when the ice tray is to be turned 90°, the one of the arms is easily come to contact with a side face of the one of the guide grooves and thus an unfavorable force is easily applied to the arm. As a result, in the ice making device, a load to the drive motor becomes higher.

SUMMARY OF THE INVENTION

In view of the problems described above, at least an embodiment of the present invention may advantageously provide an ice making device which is capable of reducing a load to a drive mechanism for moving an ice tray.

According to at least an embodiment of the present invention, there may be provided an ice making device including an ice tray, a drive mechanism for moving the ice tray to a water-supply position where water is supplied to the ice tray and to an ice making position where the water in the ice tray is frozen, cooling bodies which are entered into the ice tray from an upper side of the ice tray at the ice making position to freeze the water, two guide plates which are disposed with a predetermined distance between the two guide plates and each of which is formed with a guide groove for guiding the ice tray to the water-supply position and to the ice making position, two engaging projections which are provided on the ice tray and each of which is engaged with the guide groove, and two cranks each of which is formed with a drive groove with which the engaging projection is engaged and is connected with the drive mechanism to be turned for moving the ice tray. The water-supply position is located at a position which is separated from the ice making position in a lateral direction, and the two engaging projections are provided on the ice tray so that their axial direction are substantially coincided with each other, and a gravity center position of the ice tray is located on the lower side of the two engaging projections.

In the ice making device described above, the engaging projections provided on the ice tray are respectively engaged with the guide grooves formed in two guide plates which are disposed with a predetermined distance between the two guide plates. Further, the two engaging projections are provided on the ice tray so that their axial direction are substantially coincided with each other. In addition, the gravity center position of the ice tray is located on the lower side of the two engaging projections. Therefore, when the ice tray is moved, an unfavorable force is hardly applied to the engaging projection. As a result, according to the embodiment of the present invention, a load to the drive mechanism for moving the ice tray can be reduced. In accordance with an embodiment of the present invention, the two engaging projections which are provided on the ice tray may be mounted on the ice tray by using a separated member or may be integrally formed on the ice tray.

In accordance with an embodiment of the present invention, the guide groove includes a first groove part for guiding the ice tray in a downward direction from the ice making position and a second groove part which is formed to be connected with the lower end of the first groove part for guiding the ice tray to the water-supply position, and the drive groove formed in the crank is provided with a projection abutting face for abutting with the engaging projection at least in a boundary part between the first groove part and the second groove part when the ice tray is moved from the water-supply position to the ice making position, and the projection abutting face is inclined in such a direction that a frictional force between the side face of the guide groove in the boundary part and the engaging projection is reduced when the ice tray is moved from the water-supply position to the ice making position. For example, the boundary part is formed in a curved shape, and the projection abutting face is inclined so that a direction in which the projection abutting face presses the engaging projection is approached closer to a tangential direction of the boundary part than a turning direction of the crank in the boundary part when the ice tray is moves from the water-supply position to the ice making position.

Further, in accordance with an embodiment of the present invention, the drive groove formed in the crank is provided with a projection abutting face which is abutted with the engaging projection when the ice tray is moved from the water-supply position to the ice making position, and the projection abutting face is formed as an inclined face which is inclined so that a frictional force between a side face of the guide groove and the engaging projection is reduced when the ice tray having the engaging projection is moved upward along the guide groove. In this case, it may be structured that the inclined face formed in the projection abutting face is inclined with respect to a straight line which is formed by connecting a turning center of the crank with a center of the engaging projection. Further, it may be structured that the drive groove formed in the crank with which the engaging projection is engaged is formed to extend from a turning center side of the crank to a tip end side, and a groove width of the drive groove is formed narrower in a tapered shape toward the tip end side.

According to the structure as described above, a frictional force between the side face of the guide groove and the engaging projection can be reduced in the boundary part between the first groove part and the second groove part where the frictional force will be liable to be largest. In other words, when the ice tray is moved from the water-supply position to the ice making position, a force with which the engaging projection is pressed against the side face of the guide groove can be reduced in the boundary part. Therefore, a load to the drive mechanism for moving the ice tray can be reduced. Further, abrasion of the guide groove, the drive groove and the engaging projection can be restrained.

In accordance with an embodiment of the present invention, the projection abutting face is inclined so that the direction in which the projection abutting face presses the engaging projection is substantially the same as the tangential direction of the boundary part in the boundary part. According to the structure as described above, when the ice tray is moved from the water-supply position to the ice making position, the force with which the engaging projection is pressed against the side face of the guide groove can be effectively reduced in the boundary part. In other words, the frictional force between the side face of the guide groove and the engaging projection in the boundary part can be reduced effectively.

Further, in accordance with an embodiment of the present invention, the drive mechanism includes a motor as a drive source and a gear mechanism which is driven by the motor and the drive mechanism is mounted on one of the two guide plates, and one end side of each of the two cranks is fixed to a crank turning shaft which is turnably held by the two guide plates so that the two cranks are turnable with the crank turning shaft as a turning center, and the two cranks are turned at both sides of the ice tray by turning the crank turning shaft through the gear mechanism.

In this case, it is preferable that the crank turning shaft is disposed at a middle position between the water-supply position and the ice making position, and the guide groove includes a first groove part for guiding the ice tray toward a lower side from the ice making position and a second groove part which is gradually curved upward for guiding the ice tray from the lower side in the first groove part to the water-supply position. Further, it is preferable that the crank turning shaft is located on a water-supply position side with respect to the lowest position of the guide groove which is formed with the first groove part and the second groove part.

As described above, in accordance with the embodiment of the present invention, the inclined face is formed for reducing the force with which the engaging projection is pressed against the side face of the guide groove when the ice tray is moved from the water-supply position to the ice making position. Therefore, the frictional force between the side face of the guide groove and the engaging projection when the engaging projection is moved from the second groove part formed in a gradually curved shape to the first groove part formed in the vertical direction can be reduced even when the crank turning shaft is disposed at a middle position between the water-supply position and the ice making position.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

An embodiment of the present invention will be described below with reference to the drawings.

Figure 1:
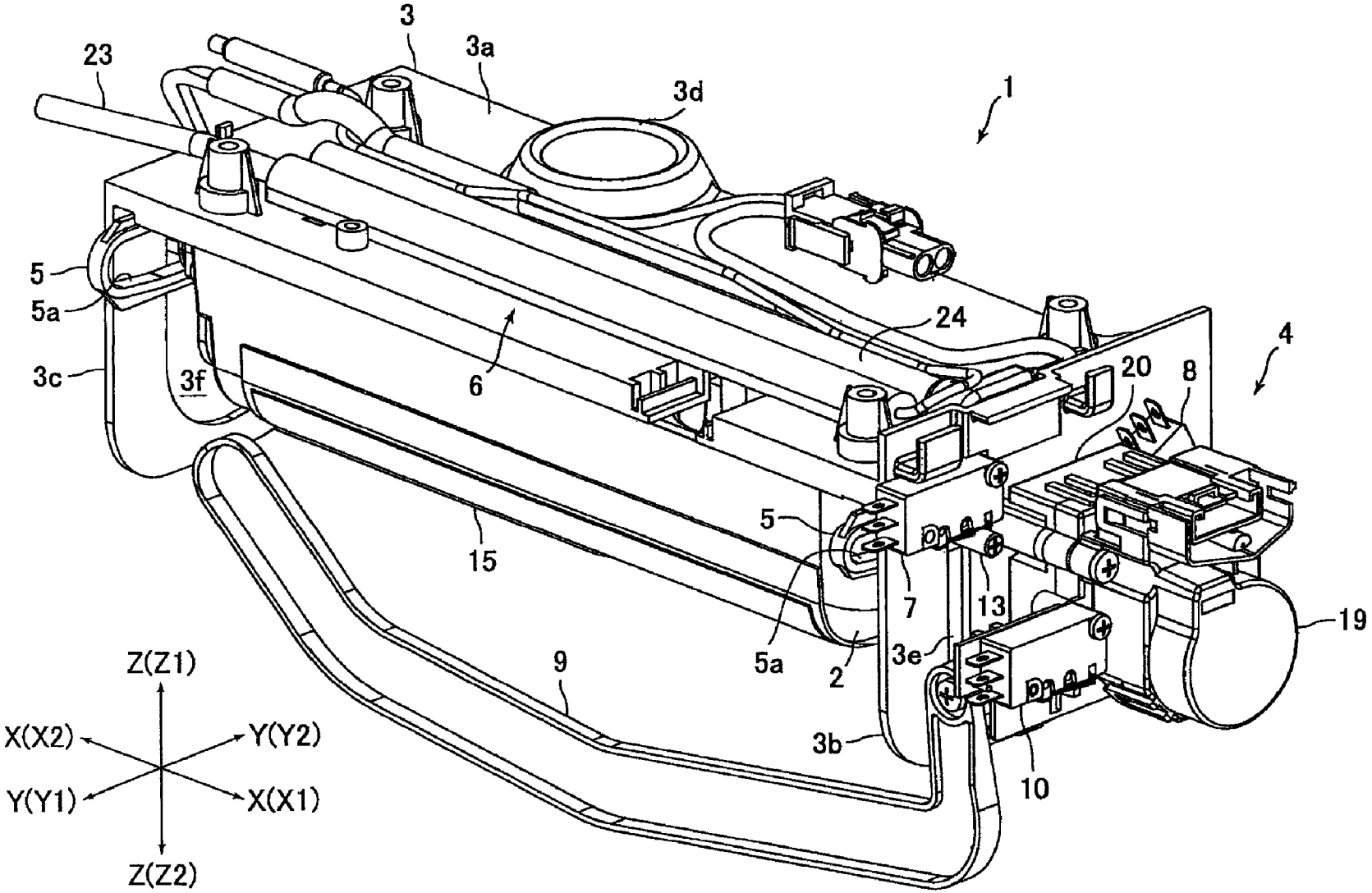
FIG. 1 is a perspective view showing an ice making device in accordance with an embodiment of the present invention.
Figure 2:
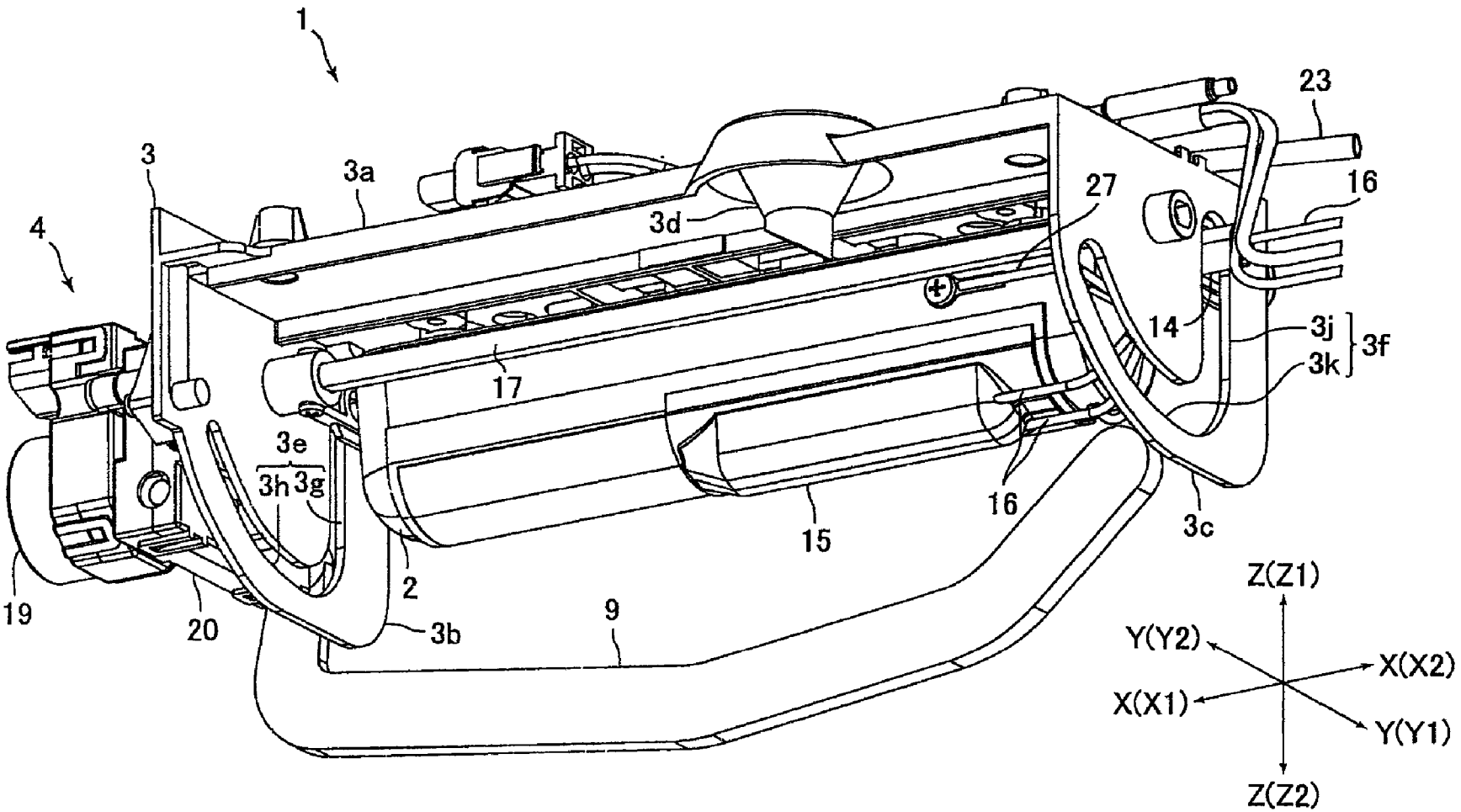
FIG. 2 is a perspective view showing the ice making device shown in FIG. 1 which is viewed from a different direction.
Figure 3:
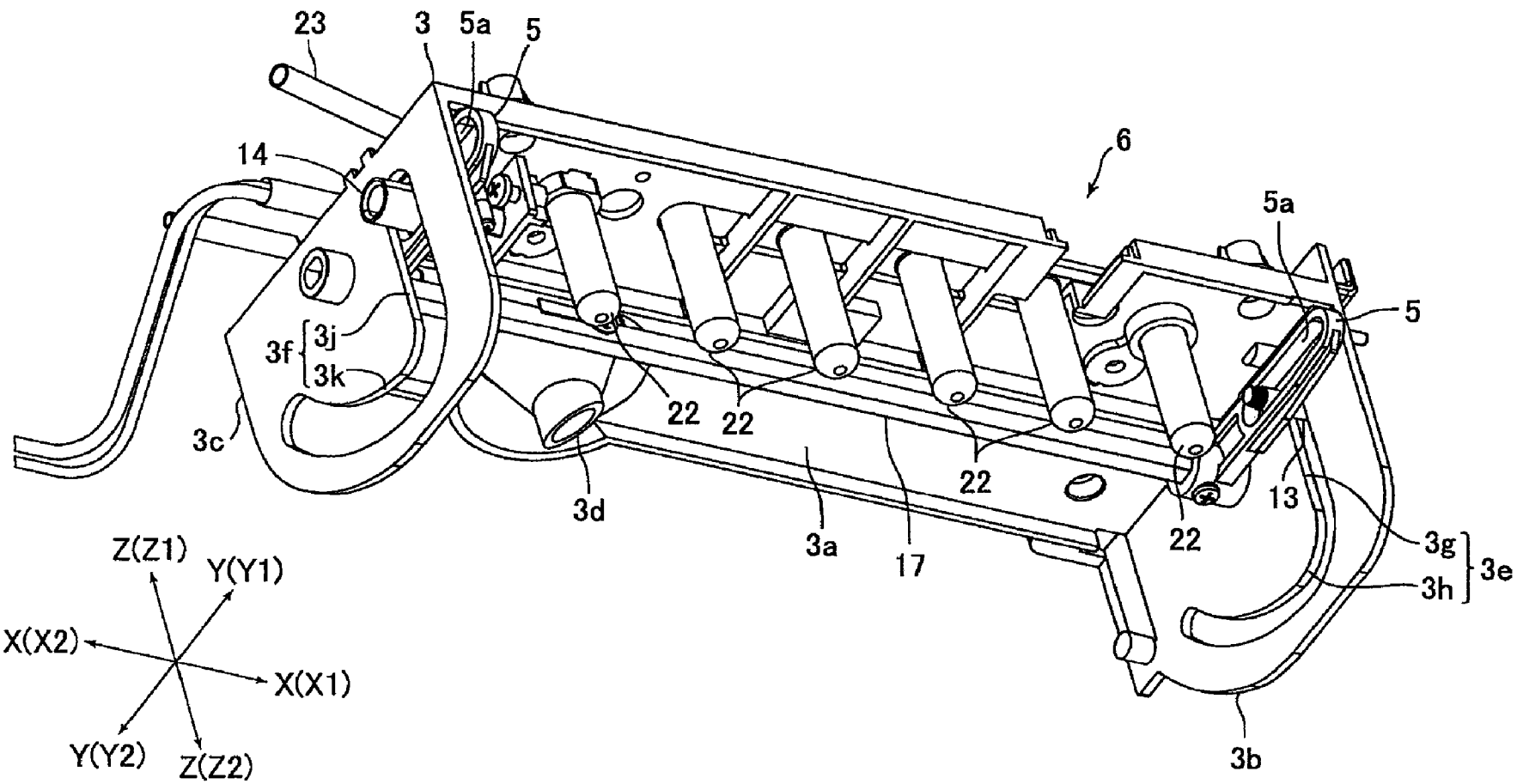
FIG. 3 is a perspective view showing a state where an ice tray and the like are detached from the ice making device shown in FIG. 1, and which is viewed from a different direction.
Figure 4:
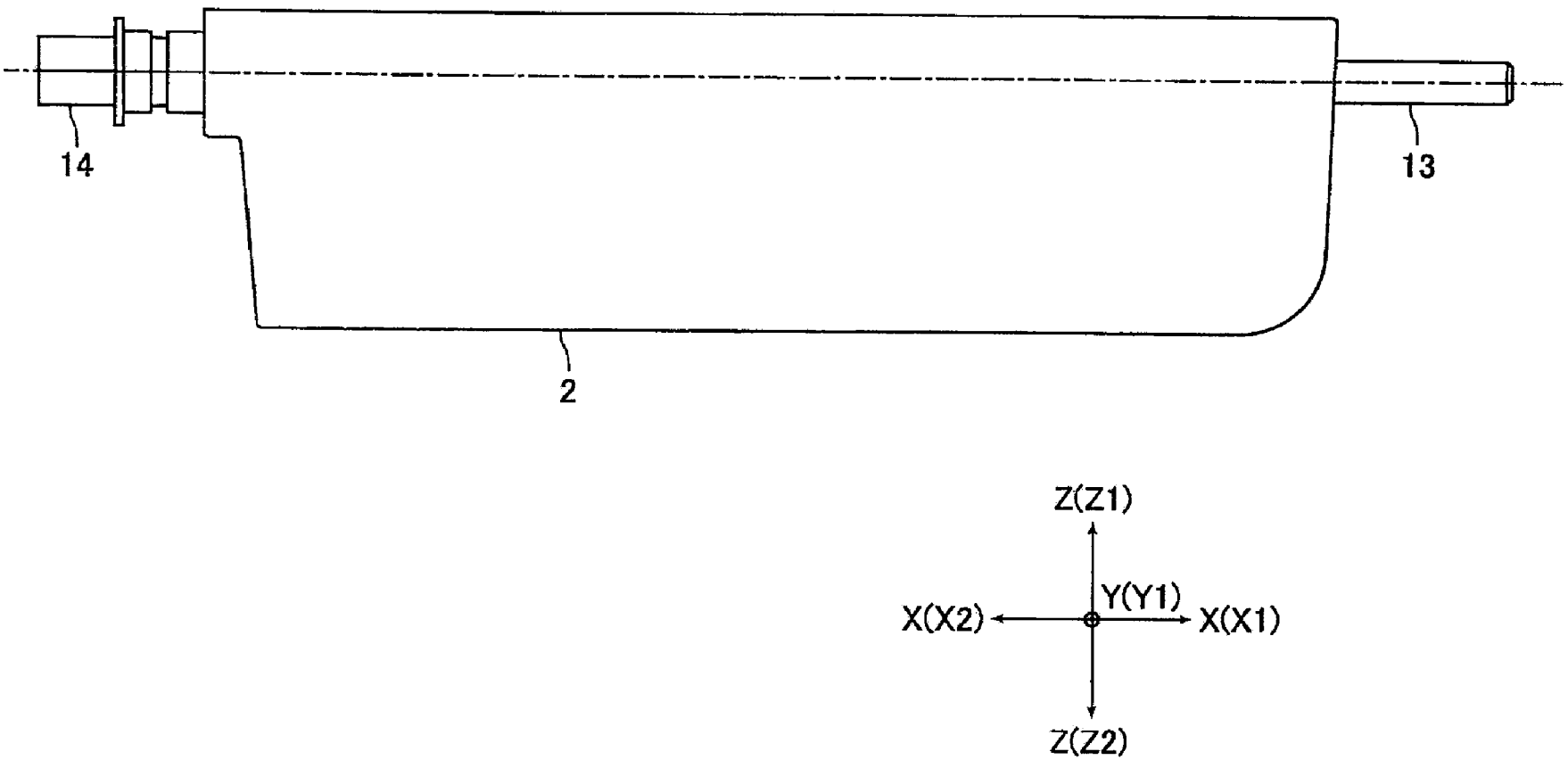
FIG. 4 is a front view showing an ice tray, an engagement pin and an engaging tube shown in FIG. 1.

FIG. 1 is a perspective view showing an ice making device 1 in accordance with an embodiment of the present invention. FIG. 2 is a perspective view showing the ice making device 1 shown in FIG. 1 which is viewed from a different direction. FIG. 3 is a perspective view showing a state where an ice tray 2 and the like are detached from the ice making device 1 shown in FIG. 1, and which is viewed from a different direction. FIG. 4 is a front view showing the ice tray 2, an engagement pin 13 and an engaging tube 14 shown in FIG. 1.

In the following description, as shown in FIG. 1 and the like, three directions perpendicular to each other are set to be X-direction, Y-direction and Z-direction. Further, in the following description, the X1-direction side is set to be "right" side, the X2-direction side is set to be "left" side, the Y1-direction side is set to be "front (or before)" side, the Y2-direction side is set to be "rear" (or back) side, the Z1-direction side is set to be "upper" side, and the Z2-direction side is set to be "lower" side. Further, in the following description, a plane which is formed by the X-direction and the Y-direction is set to be XY-plane, and a plane which is formed by the Y-direction and the Z-direction is set to be YZ-plane.

The ice making device 1 in this embodiment is, for example, used in a refrigerator for automatically making ice pieces. The ice making device 1 is provided with an ice tray 2 and the ice tray 2 is moved to a water-supply position where water is supplied to the ice tray 2 and to an ice making position where water in the ice tray 2 is frozen. In this embodiment, the position of the ice tray 2 when the ice tray 2 is disposed on an underside of a water-supply part 3*d* is a water-supply position (see FIG. 7(A)), and the position of the ice tray 2 when cooling bodies 22 are entered into the ice tray 2 is an ice making position (see FIG. 7(B)).

The ice making device 1 includes the ice tray 2, a frame 3, a drive mechanism 4 for moving the ice tray 2 between the water-supply position and the ice making position, two cranks 5 which are connected with the drive mechanism 4 for moving the ice tray 2, a cooling mechanism 6 for freezing water in the ice tray 2, a first sensor 7 and a second sensor 8 for detecting a position of the ice tray 2, an ice detecting lever 9 for detecting a remaining amount of ice pieces in an ice storage container (not shown) where ice pieces are stored, and a third sensor 10 for detecting a position of the ice detecting lever 9.

The frame 3 includes a top plate part 3*a* which is parallel to the XY-plane and formed in a roughly flat plate shape, and two side plate parts 3*b* and 3*c* which are parallel to the YZ-plane and formed in a roughly flat plate shape. The frame 3 is, as a whole, formed in a roughly rectangular groove shape. The side plate part 3*b* is formed downward from a right-side end of the top plate part 3*a* and the side plate part 3*c* is formed downward from a left-side end of the top plate part 3*a*. In other words, the side plate parts 3*b* and 3*c* are disposed so as to have a predetermined space in the right and left direction.

A water-supply part 3*d* for supplying water into the ice tray 2 is formed on the back end side of the top plate part 3*a*. A water-supply mechanism not shown in the drawing is connected with an upper end of the water-supply part 3*d* and water is supplied into the ice tray 2 from a lower end of the water-supply part 3*d*.

The side plate part 3*b* is formed with a guide groove 3*e*, which penetrates through the side plate part 3*b*, for guiding the ice tray 2 to the water-supply position and to the ice making position. Similarly, the side plate part 3*c* is formed with a guide groove 3*f*, which penetrates through the side plate part 3*c*, for guiding the ice tray 2 to the water-supply position and to the ice making position. In this embodiment, the side plate parts 3*b* and 3*c* are guide plates in which the guide grooves 3*e* and 3*f* for guiding the ice tray 2 are formed.

The guide groove 3*e* is formed so that its shape viewed from the right and left direction is in a substantially "J" shape. Specifically, as shown in FIGS. 2 and 3, the guide groove 3*e* is structured of a first groove part 3*g*, which is substantially parallel to the vertical direction and formed in a straight-line shape, and a second groove part 3*h* which is formed in a curved-shape. The first groove part 3*g* is formed on a front end side of the side plate part 3*b*. The second groove part 3*h* is formed to be connected with a bottom end of the first groove part 3*g* and formed toward the back side from the bottom end of the first groove part 3*g*. Therefore, the lowest part of the guide groove 3*e* is formed between the first groove part 3*g* and the second groove part 3*h*. Further, the second groove part 3*h* is gradually curved upward toward the back side, in other words, the second groove part 3*h* is formed so as to gradually go upward.

Similarly, the guide groove 3*f* is formed so that its shape viewed from the right and left direction is in a substantially "J" shape. In other words, the guide groove 3*f* is structured of a first groove part 3*j*, which is substantially parallel to the vertical direction and formed in a straight-line shape, and a second groove part 3*k* which is formed in a curved-shape. The first groove part 3*j* is formed on a front end side of the side plate part 3*c*. The second groove part 3*k* is formed to be connected with a bottom end of the first groove part 3*j* and formed toward the back side from the bottom end of the first groove part 3*j*. Further, the second groove part 3*k* is gradually curved upward toward the back side. In this embodiment, a width of the guide groove 3*f* is set to be wider than a width of the guide groove 3*e*.

The ice tray 2 is disposed on a lower side of the top plate part 3*a* and between the side plate parts 3*b* and 3*c* in the right and left direction. A cylindrical engaging pin 13 which is engaged with the guide groove 3*e* is mounted on the right-side end of the ice tray 2 so as to protrude in the right direction. Further, an engaging tube 14, which is formed in a roughly cylindrical shape and which is engaged with the guide groove 3*f*, is mounted on the left-side end of the ice tray 2 so as to protrude in the left direction. As shown in FIG. 4, in this embodiment, the engaging pin 13 and the engaging tube 14 are mounted on the ice tray 2 so that an axial direction of the engaging pin 13 is substantially coincided with the axial direction of the engaging tube 14. In other words, the engaging pin 13 and the engaging tube 14 are mounted on the ice tray 2 so that an axial center of the engaging pin 13 is substantially coincided with an axial center of the engaging tube 14 when viewed from the right and left direction.

Further, as shown in FIG. 4, the engaging pin 13 and the engaging tube 14 are mounted on an upper end side of the ice tray 2. In other words, in this embodiment, a gravity center position of the ice tray 2 is located lower than the engaging pin 13 and the engaging tube 14. In addition, the engaging pin 13 and the engaging tube 14 are mounted at a roughly center position of the ice tray 2 in the front and rear direction. An outer diameter of the engaging pin 13 is set to be smaller than a width of the guide groove 3*e*. Further, an outer diameter of the engaging tube 14 is set to be smaller than a width of the guide groove 3*f*. The engaging pin 13 and the engaging tube 14 in this embodiment are engaging projections which are engaged with the guide grooves 3*e* and 3*f*.

The engaging pin 13 is inserted into the guide groove 3*e* and a drive groove 5*a* which is formed in the crank 5. The right-side end of the engaging pin 13 is protruded toward the right side from the right side face of the side plate part 3*b*. Further, the engaging tube 14 is inserted into a drive groove 5*a* and the guide groove 3*f*, and the left-side end of the engaging tube 14 is protruded toward the left side from the left side face of the side plate part 3*c*.

As shown in FIG. 2, a heater 15 is mounted on an under face of the ice tray 2. Connecting wires 16 are connected to the heater 15. The connecting wires 16 are drawn out toward the left side from the ice making device 1 through the inner side of the engaging tube 14.

One end of the crank 5 is fixed to a crank turning shaft 17, whose both ends are turnably supported by the side plate parts 3*b* and 3*e* of the frame 3, and the crank 5 is turnable with the crank turning shaft 17 as its center. Two cranks 5 are disposed on inner sides of the side plate parts 3*b* and 3*c* in the right and left direction. Further, the two cranks 5 are disposed on outer sides of the ice tray 2 in the right and left direction.

The crank 5 is formed with the drive groove 5*a*, with which the engaging pin 13 or the engaging tube 14 is engaged, so as to penetrate through the crank 5 in the right and left direction. A detailed structure of the drive groove 5*a* will be described below.

The crank turning shaft 17 is held by the side plate parts 3*b* and 3*c* on upper end sides of the side plate parts 3*b* and 3*c*. Further, in the front and rear direction, the crank turning shaft 17 is disposed at roughly center positions of the side plate parts 3*b* and 3*c*, in other words, at a middle position between the water-supply position and the ice making position in the front and rear direction. Further, the position of the crank turning shaft 17 is located on the water-supply position side with respect to the position of the lowest part of the guide groove 3*e* which is formed between the first groove part 3*g* and the second groove part 3*h* (see FIG. 6). The right-side end of the crank turning shaft 17 is connected with a gear mechanism 20 which structures the drive mechanism 4.

In this embodiment, when the crank 5 is turned with the crank turning shaft 17 as its turning center, the engaging pin 13 and the engaging tube 14 which engage with the drive grooves 5*a* are moved along the guide grooves 3*e* and 3*f*. In other words, when the cranks 5 are turned with the crank turning shaft 17 as its center, the ice tray 2 is moved along the guide grooves 3*e* and 3*f*.

The drive mechanism 4 is provided with a motor 19 as a drive source and a gear mechanism 20 for transmitting power of the motor 19 to the crank turning shaft 17. The gear mechanism 20 is fixed to a right side face of the side plate part 3*b*. Further, the motor 19 is fixed to a right side face of the gear mechanism 20.

Figure 8A:
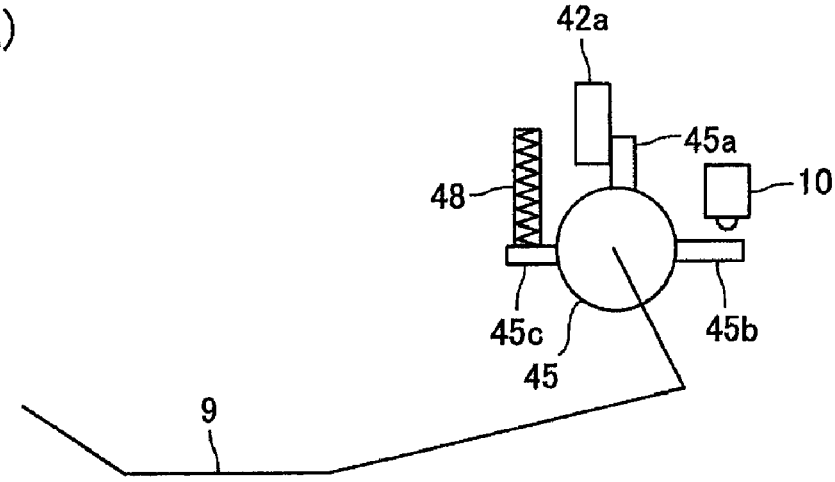
FIGS. 8(A) through 8(C) are views for explaining movement of an ice detecting lever shown in FIG. 1.
Figure 8B:
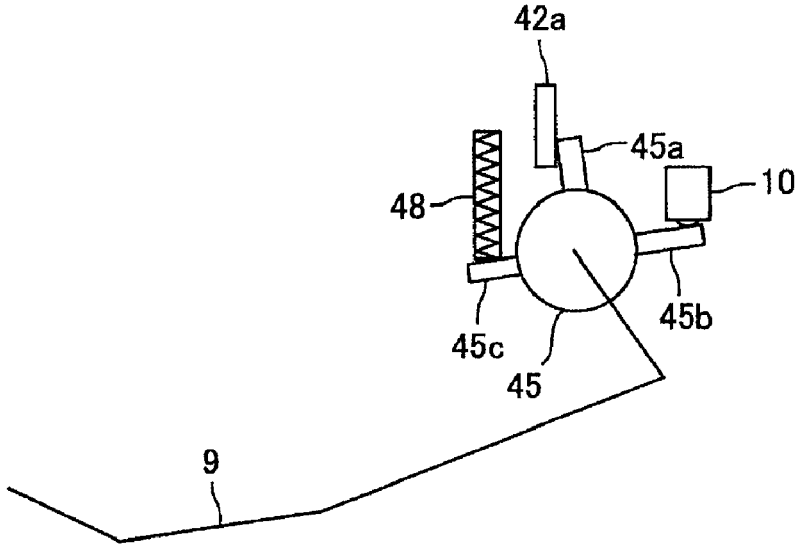
Figure 8C:
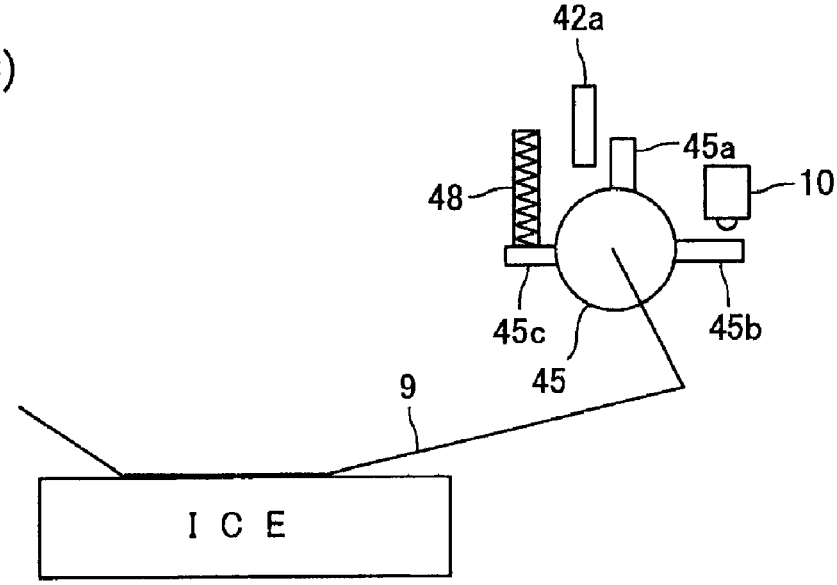

The gear mechanism 20 is provided with a plurality of gears (not shown), a lever turning shaft 45 for turning the ice detecting lever 9, and a compression coil spring 48 for urging the lever turning shaft 45 in a direction in which the ice detecting lever 9 is moved downward (see FIGS. 8(A) through 8(C)). A cam 42*a* (see FIGS. 8(A) through 8(C)) for turning the lever turning shaft 45 is formed on a right-side end face of one of a plurality of the gears. Further, the ice detecting lever 9 is fixed on the front end of the lever turning shaft 45, and the ice detecting lever 9 is turned with the front and rear direction as its axial direction.

The lever turning shaft 45 is formed with a cam abutting part 45*a* which is capable of abutting with the cam 42*a*, a sensor abutting part 45*b* which is capable of abutting with the third sensor 10, and a pressed part 45*c* which is pressed by the compression coil spring 48 (see FIGS. 8(A) through 8(C)). In this embodiment, the lever turning shaft 45 is urged in a counterclockwise direction in FIGS. 8(A) through 8(C) by the compression coil spring 48. In other words, the lever turning shaft 45 is urged by the compression coil spring 48 in a direction that the cam abutting part 45*a* is moved toward the cam 42*a*.

The cooling mechanism 6 is provided with a plurality of cooling bodies 22 for freezing water which enter into the ice tray 2 from an upper side of the ice tray 2 located at the ice making position, a refrigerant pipe 23 through which refrigerant for cooling the cooling bodies 22 is passed, a heater 24 for heating the cooling bodies 22 when ice pieces stuck to the cooling bodies 22 are to be dropped. The cooling bodies 22 are, as shown in FIG. 3, mounted on the top plate part 3*a* so as to protrude downward from the front end side of the top plate part 3*a* of the frame 3. The refrigerant pipe 23 and the heater 24 are mounted on an upper face of the front end side of the top plate part 3*a*.

A first sensor 7 and a second sensor 8 are mechanical contact switches which are provided with a lever member and a contact part. The first sensor 7 and the second sensor 8 are, as shown in FIG. 1, fixed to the right side face of the side plate part 3*b*. Specifically, the first sensor 7 is fixed to the upper end of the first groove part 3*g* of the guide groove 3*e* and the second sensor 8 is fixed to the upper end of the second groove part 3*h* of the guide groove 3*e*. In this embodiment, when the engaging pin 13 fixed to the ice tray 2 is abutted with the lever member of the first sensor 7 to press the contact part, the ice tray 2 is detected to be located at the ice making position. Further, when the engaging pin 13 is abutted with the lever member of the second sensor 8 to press the contact part, the ice tray 2 is detected to be located at the water-supply position.

The third sensor 10 is, similarly to the first sensor 7 and the second sensor 8, a mechanical contact switch provided with a lever member and a contact part. The third sensor 10 is fixed to a right side face of the gear mechanism 20. In this embodiment, when the sensor abutting part 45*b* of the lever turning shaft 45 is abutted with the lever member of the third sensor 10 to press the contact part, it is detected that a remaining amount of ice pieces in the ice storage container is a little.

In this embodiment, when the engaging pin 13 is disposed at the upper end of the first groove part 3*g* and the engaging tube 14 is disposed at the upper end of the first groove part 3*j*, the cooling bodies 22 are entered into the ice tray 2. In other words, at this position, the ice tray 2 is located at the ice making position. Further, when the engaging pin 13 is disposed at the upper end of the second groove part 3*h* of the guide groove 3*e* and the engaging tube 14 is disposed at the upper end of the second groove part 3*k* of the guide groove 3*f*, the ice tray 2 is disposed at the lower side of the water-supply part 3*d*. In other words, at this position, the ice tray 2 is located at the water-supply position and the water-supply position is set to shift backward from the lower side of the cooling bodies 22.

Figure 5:
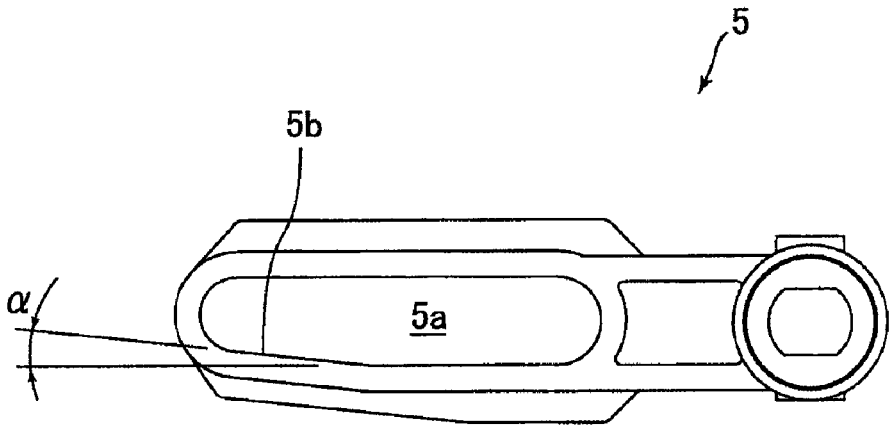
FIG. 5 is a front view showing a crank shown in FIG. 1.
Figure 6:
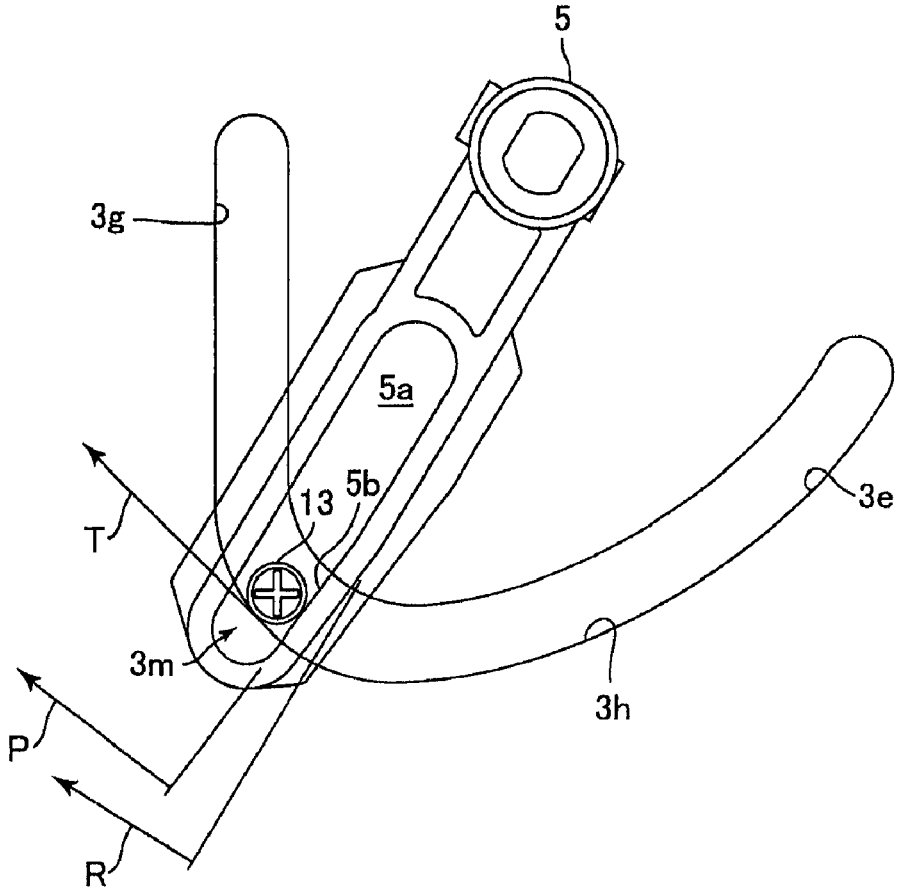
FIG. 6 is a view for explaining a structure of a drive groove for the crank shown in FIG. 5.

FIG. 5 is a front view showing the crank shown in FIG. 1. FIG. 6 is a view for explaining a structure of the drive groove 5*a* shown in FIG. 5.

As described above, the crank 5 is formed with the drive groove 5*a*. As shown in FIG. 5, the drive groove 5*a* is generally formed in a roughly straight shape whose longitudinal direction is the right and left direction in FIG. 5. In this embodiment, a lower side face on the left side of the drive groove 5*a* in FIG. 5 is inclined by the angle "a" with respect to a lower side face on the right side of the drive groove 5*a* in FIG. 5. In other words, the lower side face of the left-side end of the drive groove 5*a* in FIG. 5 is gradually inclined upward toward the left side end in FIG. 5.

As shown in FIG. 6, the inclined lower side face portion of the drive groove 5*a* is abutted with the engaging pin 13 (or the engaging tube 14) at a boundary part 3*m* between the first groove part 3*g* (or 3*j*) and the second groove part 3*h* (or 3*k*) when the ice tray 2 is moved from the water-supply position to the ice making position. In other words, the inclined lower side face portion of the drive groove 5*a* is a projection abutting face 5*b* which is abutted with the engaging pin 13 (or the engaging tube 14) at the boundary part 3*m* when the ice tray 2 is moved from the water-supply position to the ice making position. In this embodiment, the boundary part 3*m* is a portion which is formed in a curved shape so as to connect the second curved groove part 3*h* (or 3*k*) that gradually goes upward with the first groove part 3*g* (or 3*j*) formed linearly in the vertical direction. Specifically, the boundary part 3*m* is formed in a substantially circular arc shape.

The projection abutting face 5*b* is inclined in a direction so that a frictional force between a side face of the guide groove 3*e* (or 3*f*) in the boundary part 3*m* and the engaging pin 13 (or engaging tube 14) is reduced when the ice tray 2 is moved from the water-supply position to the ice making position. In other words, in the boundary part 3*m* when the ice tray 2 is moved from the water-supply position to the ice making position, the projection abutting face 5*b* is inclined so that a force is reduced with which the engaging pin 13 (or the engaging tube 14) is pressed against the side face of the guide groove 3*e* (or 3*f*). In other words, the projection abutting face 5*b* is inclined so that the engaging pin 13 (or the engaging tube 14) are not sandwiched by the side face of the guide groove 3*e* (or 3*f*) and the side face of the drive groove 5*a*.

Specifically, as shown in FIG. 6, when the ice tray 2 is moved in the boundary part 3*m* from the water-supply position to the ice making position, the projection abutting face 5*b* is formed in the inclined face such that the direction "P" in which the projection abutting face 5*b* presses the engaging pin 13 (or the engaging tube 14) is approached closer to the tangential direction "T" of the lower side face of the boundary part 3*m* than the turning direction "R" of the crank 5 in the boundary part 3*m*, i.e., than the substantially orthogonal direction to the straight line that is formed by connecting the turning center of the crank 5 with the center of the engaging pin 13 (or the engaging tube 14). In other words, the inclined face is formed to incline with respect to the straight line which is connected between the turning center of the crank 5 and the center of the engaging pin 13 so that a frictional force between the side face of the guide groove and the engaging pin 13 is reduced when the engaging pin 13 (or the engaging tube 14) is going to move upward. Specifically, the inclined face is formed in a tapered shape so that a groove width of the drive groove 5*a* becomes narrower toward the tip end of the drive groove 5*a*.

In this embodiment, a width of the drive groove 5*a* with which the engaging pin 13 is engaged is set to be larger than an outer diameter of the engaging pin 13. Further, a width of the drive groove 5*a* with which the engaging tube 14 is engaged is set to be larger than an outer diameter of the engaging tube 14.

FIGS. 7(A) through 7(E) are views for explaining an ice making operation in the ice making device 1 shown in FIG. 1. FIGS. 8(A) through 8(C) are views for explaining movement of an ice detecting lever 9 shown in FIG. 1.

Figure 7A:
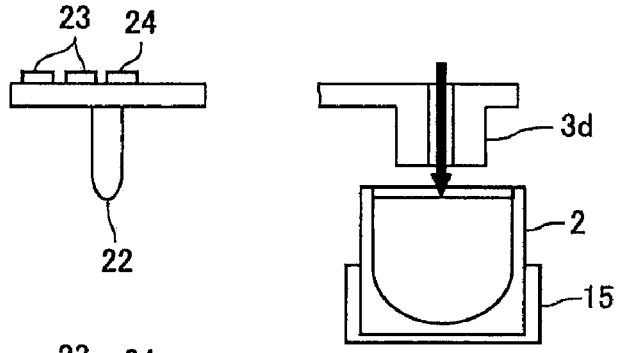
FIGS. 7(A) through 7(E) are views for explaining an ice making operation in the ice making device shown in FIG. 1.

In the ice making device 1 structured as described above, ice pieces are made as follows. First, as shown in FIG. 7(A), water is supplied into the ice tray 2 located at the water-supply position. In other words, water is supplied into the ice tray 2 which is disposed on an under side of the water-supply part 3*d*.

Figure 7B:
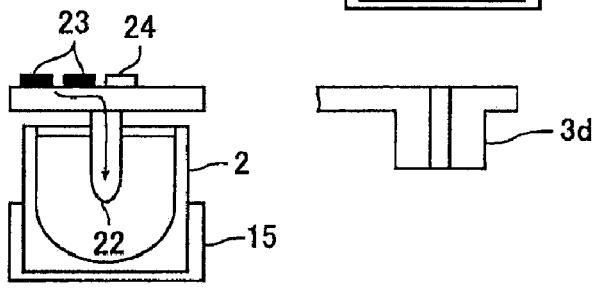

Next, the cranks 5 are turned to move the ice tray 2 to the ice making position where the engaging pin 13 is disposed on the upper end of the first groove part 3*g* and the engaging tube 14 is disposed on the upper end of the first groove part 3*j* (see FIG. 7(B)). When the ice tray 2 is moved to the ice making position, the cooling bodies 22 enter into the ice tray 2. In this state, refrigerant is passed through the refrigerant pipe 23 to cool the cooling bodies 22 and water in the ice tray 2 is frozen.

Figure 7C:
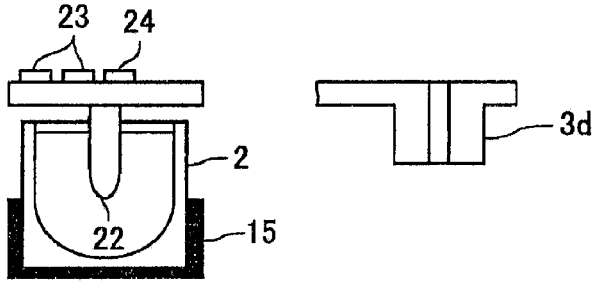
Figure 7D:
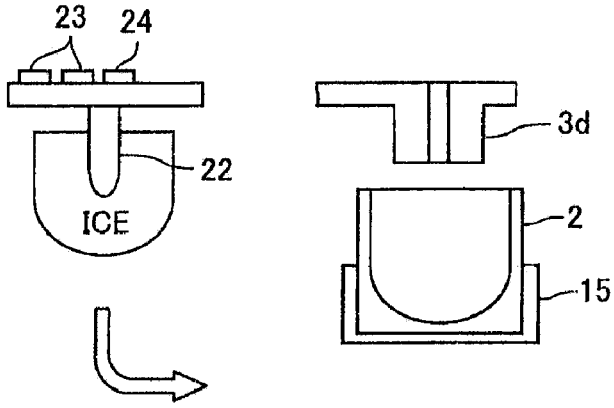

Next, as shown in FIG. 7(C), the heater 15 is set to be an "ON" state. When the heater 15 is turned on, contacting portion of ice with the ice tray 2 is melted. Next, as shown in FIG. 7(D), the cranks 5 are turned to move the ice tray 2 to the water-supply position. At this time, first, the ice tray 2 is guided downward from the ice making position through the first groove parts 3*g* and 3*j* and then, the ice tray 2 is guided through the second groove parts 3*h* and 3*k* to the water-supply position.

Figure 7E:
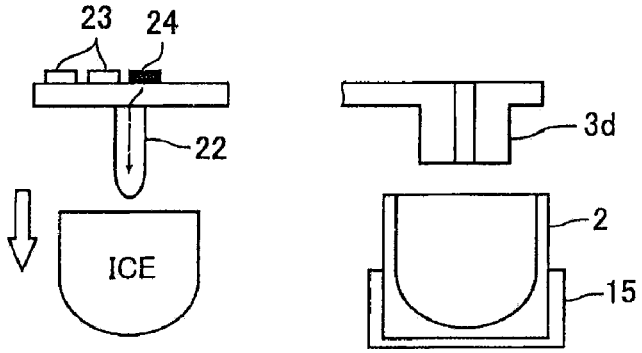

In the state that the ice tray 2 has been moved to the water-supply position, ice pieces are continuously stuck to the cooling bodies 22. Next, as shown in FIG. 7(E), the heater 24 is set to be an "ON" state and the cooling bodies 22 are heated. When the cooling bodies 22 are heated, the ice pieces which have been stuck to the cooling bodies 22 drop to the ice storage container.

The ice making operation described above is performed when a remaining amount of ice pieces is a little in the ice storage container. Specifically, a remaining amount of ice pieces in the ice storage container is detected as described below and necessity of the ice making operation is determined. In other words, as shown in FIG. 8(A), first, when the ice tray 2 is located at the water-supply position, the cam abutting part 45*a* is abutted with the cam 42*a* and the ice detecting lever 9 is located at an upper position. In this case, the third sensor 10 is in an "OFF" state.

In this state, when the motor 19 is driven in order to move the ice tray 2 to the ice making position, the gear mechanism 20 is operated and, as shown in FIGS. 8(B) and 8(C), the cam 42*a* is retreated. In other words, the cam 42*a* is retreated in cooperation with movement of the ice tray 2. When a remaining amount of ice pieces in the ice storage container is a little or there is no ice piece in the ice storage container, as shown in FIG. 8(B), the detection lever 9 is moved down by an urging force of the compression coil spring 48 and the own weight of the detection lever 9 to turn the third sensor 10 in an "ON" state. When the third sensor 10 is turned to be an "ON" state, it is judged that a remaining amount of ice pieces in the ice storage container is a little, in other words, it is judged that an ice making operation is required and thus the ice tray 2 is continuously moved as it is to the ice making position to perform an ice making operation.

On the other hand, in a case that a remaining amount of ice pieces in the ice storage container is much, even when the cam 42*a* is retreated, as shown in FIG. 8(C), the detection lever 9 is contacted with ice pieces in the ice storage container and is not moved down. Therefore, the third sensor 10 is not turned in an "ON" state. When the third sensor 10 is not turned in an "ON" state, it is judged that a remaining amount of ice pieces in the ice storage container is much, in other words, it is judged that an ice making operating is not required and then, the ice tray 2 is returned to the water-supply position again to stand by.

In this embodiment, the ice tray 2 normally stands by at the water-supply position. Further, in this embodiment, the ice tray 2 starts to move to the ice making position with a regular interval and, when an ice making operation is required, the ice tray 2 is continuously moved to the ice making position and, when an ice making operation is not required, the ice tray 2 is returned to the water-supply position again.

As described above, in this embodiment, the engaging pin 13 and the engaging tube 14 provided in the ice tray 2 are respectively engaged with the guide grooves 3*e* and 3*f* formed in the side plate parts 3*b* and 3*c*, which are disposed with a predetermined space in the right and left direction. Further, the engaging pin 13 and the engaging tube 14 are formed on the ice tray 2 so that their axial directions are substantially coincided with each other. In addition, the gravity center position of the ice tray 2 is located lower than the engaging pin 13 and the engaging tube 14. Therefore, when the ice tray 2 is moved between the water-supply position and the ice making position, a coersive force is hardly applied to the engaging pin 13 and the engaging tube 14. Therefore, in this embodiment, a load to the motor 19 is capable of being reduced. Further, since a load to the motor 19 is capable of being reduced, generation of heat in the motor 19 can be restrained.

In this embodiment, the projection abutting face 5*b* is inclined to a direction so that a frictional force between the side face of the guide groove 3*e* and the engaging pin 13 (or the engaging tube 14) is reduced in the boundary part 3*m* (or 3*f*) when the ice tray 2 is moved from the water-supply position to the ice making position. Specifically, when the ice tray 2 is moved from the water-supply position to the ice making position in the boundary part 3*m*, the projection abutting face 5*b* is formed in the inclined face such that the direction "P" in which the projection abutting face 5*b* presses the engaging pin 13 (or engaging tube 14) is approached closer to the tangential direction "T" of the boundary part 3*m* than the turning direction "R" of the crank 5 in the boundary part 3*m*.

Therefore, a frictional force can be reduced which is acted between the side face of the guide groove 3*e* (or 3*f*) and the engaging pin 13 (or the engaging tube 14) in the boundary part 3*m* where a frictional force between the side face of the guide groove 3*e* (or 3*f*) and the engaging pin 13 (or the engaging tube 14) is easily become largest. In other words, when the ice tray 2 is to be moved from the water-supply position to the ice making position, a force with which the engaging pin 13 (or the engaging tube 14) is pressed against the side face of the guide groove 3*e* (or 3*f*) in the boundary part 3*m* can be reduced. Therefore, in this embodiment, a load to the motor 19 can be reduced. Further, abrasion of the drive grooves 5*a*, the guide grooves 3*e* and 3*f*, the engaging pin 13 and the engaging tube 14 can be reduced.

Although the present invention has been shown and described with reference to specific embodiments, various changes and modifications will be apparent to those skilled in the art from the teachings herein.

For example, in the embodiment described above, when the ice tray 2 is moved from the water-supply position to the ice making position, the projection abutting face 5*b* is formed in the inclined face such that the direction "P" in which the projection abutting face 5*b* presses the engaging pin 13 (or the engaging tube 14) is approached closer to the tangential direction "T" of the lower side face of the boundary part 3*m* than the turning direction "R" of the crank 5 in the boundary part 3*m*. However, it is preferable that the projection abutting face 5*b* is formed in the inclined face such that the direction "P" in which the projection abutting face 5*b* presses the engaging pin 13 (or the engaging tube 14) is set to be substantially the same direction as the tangential direction T of the boundary part 3*m*.

Further, in the embodiment described above, the engaging pin 13 and the engaging tube 14 are formed separately from the ice tray 2 and mounted on the ice tray 2 but the engaging pin 13 and the engaging tube 14 may be integrally formed with the ice tray 2.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making device comprising:

an ice tray;

a drive mechanism for moving the ice tray to a water-supply position where water is supplied to the ice tray and to an ice making position where the water in the ice tray is frozen;

cooling bodies which are entered into the ice tray from an upper side of the ice tray at the ice making position to freeze the water;

two guide plates which are disposed with a predetermined distance between the two guide plates and each of which is formed with a guide groove for guiding the ice tray to the water-supply position and to the ice making position;

two engaging projections which are provided on the ice tray and each of which is engaged with one of the guide grooves; and two cranks, each of which is formed with a drive groove with which the engaging projection is engaged, and each of which is connected with the drive mechanism to be turned for moving the ice tray;

wherein the water supply position is located at a position which is separated from the ice making position in a horizontal direction generally orthogonal to a vertical direction with respect to a normal operating position of the ice making device, and the two engaging projections are provided on the ice tray so that axial centers of the two engaging projections are substantially coaxial with each other, and a center of gravity of the ice tray is located below the two engaging projections; and wherein each guide groove includes a first groove part for guiding the ice tray in a downward direction from the ice making position and a second groove part connected with a lower end of the first groove part for guiding the ice tray in an upward direction to the water-supply position.

2. The ice making device according to claim 1, wherein each drive groove is provided with a projection abutting face for abutting with one of the engaging projections at least in a boundary part located between and vertically below both of the first groove part and the second groove part when the ice tray is moved from the water supply position to the ice making position, and each projection abutting face is inclined to a direction so that a frictional force between a side face of the guide groove in the boundary part and the engaging projection is reduced when the ice tray is moved from the water-supply position to the ice making position.

3. The ice making device according to claim 2, wherein the boundary part is formed in a curved shape, and each projection abutting face is inclined so that the projection abutting face presses the engaging projection relatively closer to a tangential line of the boundary part than a tangential line of the crank in the boundary part when the ice tray is moved from the water supply position to the ice making position.

4. The ice making device according to claim 3, wherein each projection abutting face is inclined so that the projection abutting face presses the engaging projection along a line that is substantially the same as the tangential line of the boundary part.

5. The ice making device according to claim 1, wherein each drive groove is provided with an elongated projection abutting face which is abutted with one of the engaging projections when the ice tray is moved from the water supply position to the ice making position, and each elongated projection abutting face comprises a first portion and a second portion that is formed as an inclined face which is inclined at an angle with respect to the first portion so that a frictional force between a side face of the guide groove and the engaging projection is reduced when the ice tray having the engaging projection is moved upward along the guide groove.

6. The ice making device according to claim 5, wherein each inclined face formed is inclined with respect to a straight line which is formed by connecting a turning center of the crank with a center of the engaging projection.

7. The ice making device according to claim 6, wherein each drive groove is formed to extend from a turning center side of the crank to a tip end side, and a groove width of each drive groove is formed in a tapered shape toward the tip end side.

8. The ice making device according to claim 5, wherein the drive mechanism includes a motor as a drive source and a gear mechanism which is driven by the motor, and the drive mechanism is mounted on one of the two guide plates, and one end of each of the two cranks is fixed to a crank turning shaft which is turnably held by the two guide plates so that the two cranks are turnable with the crank turning shaft as a turning center, and the two cranks are turned by turning the crank turning shaft through the gear mechanism.

9. The ice making device according to claim 8, wherein the crank turning shaft is disposed at a middle position between the water supply position and the ice making position, and each guide groove includes a first groove part for guiding the ice tray toward a lower side from the ice making position and a second groove part which is gradually curved upward for guiding the ice tray from the lower side in the first groove part to the water-supply position.

10. The ice making device according to claim 9, wherein the crank turning shaft is located on a water-supply position side with respect to a lowest position of the guide grooves.

11. The ice making device according to claim 1, wherein each guide groove is formed so that its shape is in a substantially "J" shape.

12. The ice making device according to claim 11, wherein the guide grooves extend between two terminal ends, one of the terminal ends defining the water-supply position and the other terminal end defining the ice making position; and wherein the center of gravity of the ice tray is maintained below the two engaging projections as the ice tray is moved between the two terminal ends of the guide grooves.

* * * * *